United States Patent [19]

Marzocco

[11] 3,994,094

[45] Nov. 30, 1976

[54] SLIDING-WING DOOR FOR VEHICLES

[75] Inventor: Alessandro Marzocco, Milan, Italy

[73] Assignee: Socimi Societa Costruzioni Industriali Milano S.p.A., Milan, Italy

[22] Filed: May 28, 1975

[21] Appl. No.: 581,673

[30] Foreign Application Priority Data

Dec. 20, 1974 Italy ..... 30883/74

[52] U.S. Cl. ..... 49/212; 49/218; 49/221

[51] Int. Cl.[2] ..... E05D 15/10

[58] Field of Search ..... 49/212, 208, 209, 210, 49/216–218, 221, 223, 254, 255

[56] References Cited

UNITED STATES PATENTS

| | | | |
|---|---|---|---|
| 2,445,131 | 7/1948 | Wartian | 49/212 X |
| 3,293,801 | 12/1966 | Henning | 49/221 X |
| 3,412,507 | 11/1968 | Sterner | 49/212 |
| 3,728,819 | 4/1973 | Goldbach et al. | 49/218 X |

*Primary Examiner*—Kenneth Downey
*Attorney, Agent, or Firm*—Karl W. Flocks

[57] ABSTRACT

A sliding wing door, as used in railway and similar installations, is disclosed, of the kind in which the door, as it is opened, is first thrust out of its doorspace and slid alongside the vehicle body, the improvement consisting in that one of the component parts of the telescopable guide of the door panel is secured to the movable members of at least two linear ejectors intended to thrust the door panel out of the doorspace. Advantageously, the axes of the two (or more) linear ejectors are inclined through an angle of from 45° to 90° relative to the door space plane. A vertical shaft, mounted parallel and adjacent to the door post provides the initial movement of the door in a direction parallel to the ejector axes: the angle of rotation of the shaft is appropriately limited consistently with the necessity. Certain translation movements of component parts of the mechanism are aided by sets of rollers sliding on specially provided rolling paths.

6 Claims, 8 Drawing Figures

35
40
40
38
58
57
56
55
30
29
22
20
17
16
34
13
40
11
15
25
18
28
27
24
10
19
23
21
14
12

SLIDING-WING DOOR FOR VEHICLES

This invention relates to a sliding-wing door for vehicles, especially but not exclusively for rolling vehicles, of the kind which, as the door is being opened, is first displaced from its seat outwards towards the exterior of the vehicle and then caused to slide along the outer sidewall thereof.

Sliding-wing doors of the kind referred to above are known in which, to permit that the door panels may perform the twofold movement of displacement from their seat and lateral sliding, one or more sliding telescopical systems are provided which are borne by means of linked arms by the vehicle body and from which the door panels are hung in order that they may be slid laterally while remaining hung therefrom. These sliding systems are formed by rolled sections of a suitable shape which are telescopically elongated by the insertion of appropriate rolling means, one of which is made integral with the corresponding door panel, while another is connected in an oscillable manner through said linked arms to the vehicle body.

Such a system of suspension and sliding may give rise to troubles during operation since the linked arms are subjected to heavy stresses due to vibrations and the heavy weight they must support, the result being a prejudice of the door stability.

The principal object of the present invention is thus to remove these defects while providing a suspension and sliding system for doors having a sliding wing which affords improved guaranties as to stability and reliability.

With this object in view, the invention suggests a sliding wing door in which the door panels are hung, each, to a member of a telescopable guide, another member of the same guide being rigidly fastened to the movable portions of at least to linear ejectors as mounted in a rigid supporting structure affixed to the vehicle body, in correspondence with the ceiling of the door space, means being provided to cause, optionally in either direction, either directly or indirectly, a limited displacement of the movable parts of the linear ejectors and means for controlling the sliding of the member of the telescopable guide which is integral with the door panel relative to the member affixed to the movable portions of the linear ejectors.

By so doing, it is apparent that the telescopable guide from which the door panel is hung is no longer connected to the vehicle body, as it was the case with the conventional systems, through swingable linked arms, but it is borne by the movable parts of linear ejectors as mounted in a rigid structure affixed to the vehicle body, the stability of the door suspension system being thereby improved.

The linear ejectors lie on a horizontal plane and can be arranged slanting with respect to the plane containing the door space by an angle which may range from about 45°° and 90° . The selection of the orientation of the ejectors in the horizontal plane must be made, in any case, so as to obtain, both when the door is being opened and when it is being closed, the most appropriate values for the component of the force of the driving cylinder in the direction of the ejectors. By so doing, it is possible to impress to the door panels as they are displaced from their seats, either a combined movement both parallel and perpendicular to the door space, or a movement which is only perpendicular.

With an angle narrower than 45° there would be too great a displacement component parallel to the door space, that which would originate difficulties in overtaking the doorpost of the door space.

The means which are adapted to cause the limited displacement of the movable portions of the linear ejectors can be of the pneumatic or electromechanical type and can directly act upon said movable parts.

In a particular embodiment, they can be also equipped with means of the indirect action type, that is, acting upon the door panel rather than on the movable parts of the ejectors. In this case, said means consist of a vertical shaft arranged parallely to the door post of the door space and affixed to the latter by appropriate supporting members, the shaft carrying, as keyed to its ends, two small connecting rods having at their free ends a follower engaging respective guides affixed both to the top and bottom of the door panel an appropriate pneumatic or electromagnetic control means can have the shaft making limited rotations about its own axis so as to urge by means of the end connecting rods the door panel so as to displace the latter together with the telescopable guide from the door space in the direction which is permitted by the linear ejectors.

In such an embodiment, the connecting rods contribute towards imparting to the door panel in the open position a considerable stability. In addition, the control device of the rotation of the shaft which carries the connecting rods can be equipped with a locking mechanism intended to lock the door panel in its closed position preventing the door panel from being displaced in any direction.

The means for controlling either the elongation or the shrinking of the telescopable guide and then the sliding of the door panel along the outside sidewall of the vehicle can be formed in the conventional way by a pneumatic ram affixed to the vehicle body, the ram stem being connected to the door panel via a linked arm.

Of course conventional means are provided for synchronizing the manipulations of the control means for the movements in order to ensure that, as the door is being opened, the door panels are first displaced from their seat towards the outside in the direction permitted by the linear ejectors, and subsequently caused to slide laterally alongside the outer sidewall of the vehicle, and that, as the door is being closed, the sequence of operations is reversed.

The foregoing and other advantages and features of the sliding wind door according to the present invention will be more detailedly illustrated hereinafter with reference to a possible exemplary embodiment thereof and without limitation, as shown in the accompanying drawings, wherein.

Figure 1:
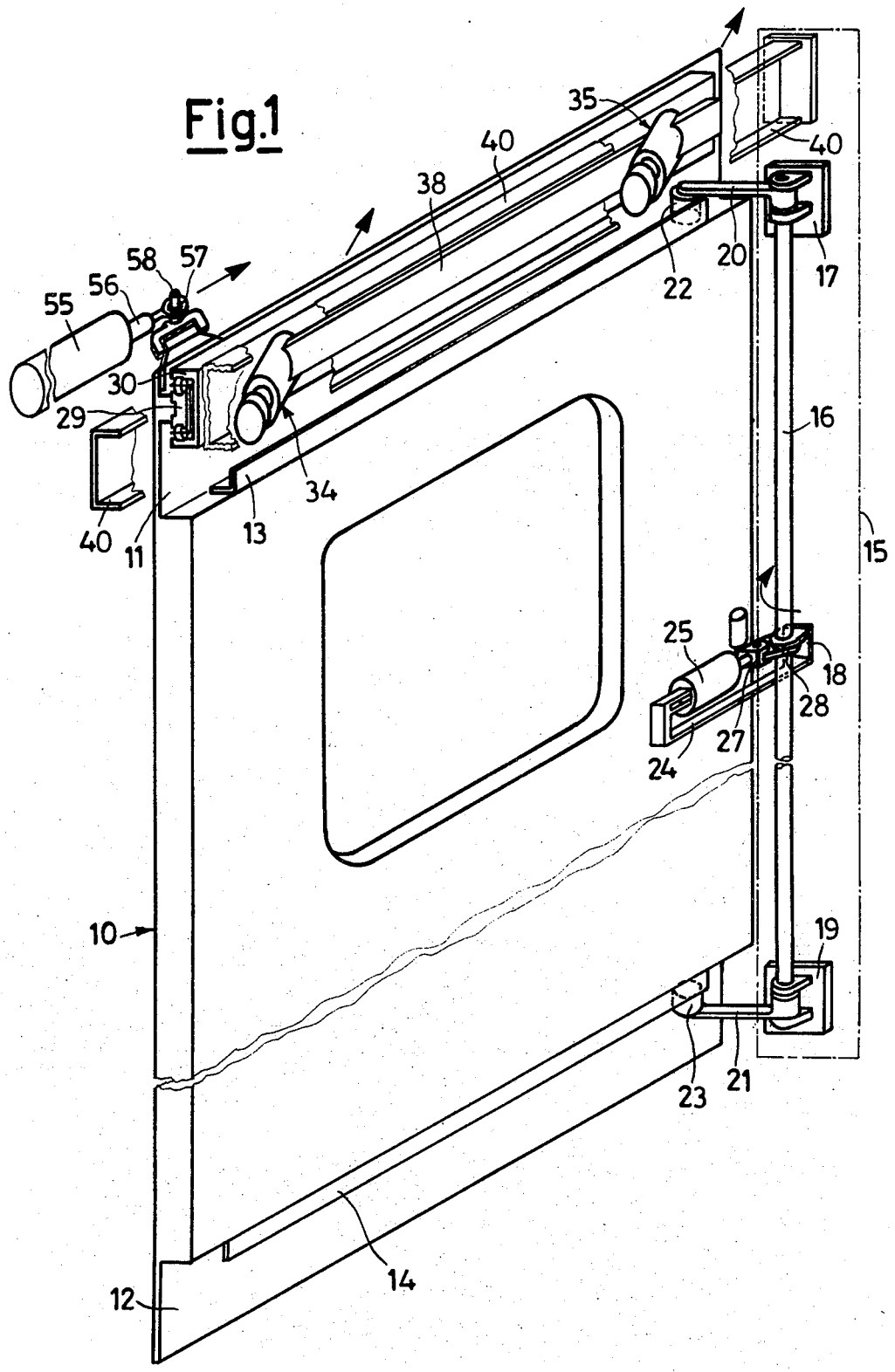
FIGS. 1 and 2 are diagrammatical perspective views as viewed from the interior of a vehicle of a door panel in the closed position and partial opening, respectively.

It should be noticed that both in the drawings and the ensuing disclosure, only a single door panel of a door is considered, it being otherwise obvious that the door may have two panels and, if so, the suspension and control means for the second door panel must be intended as being identical with, and symmetrical to, the means as shown and described hereinafter.

Figure 2:
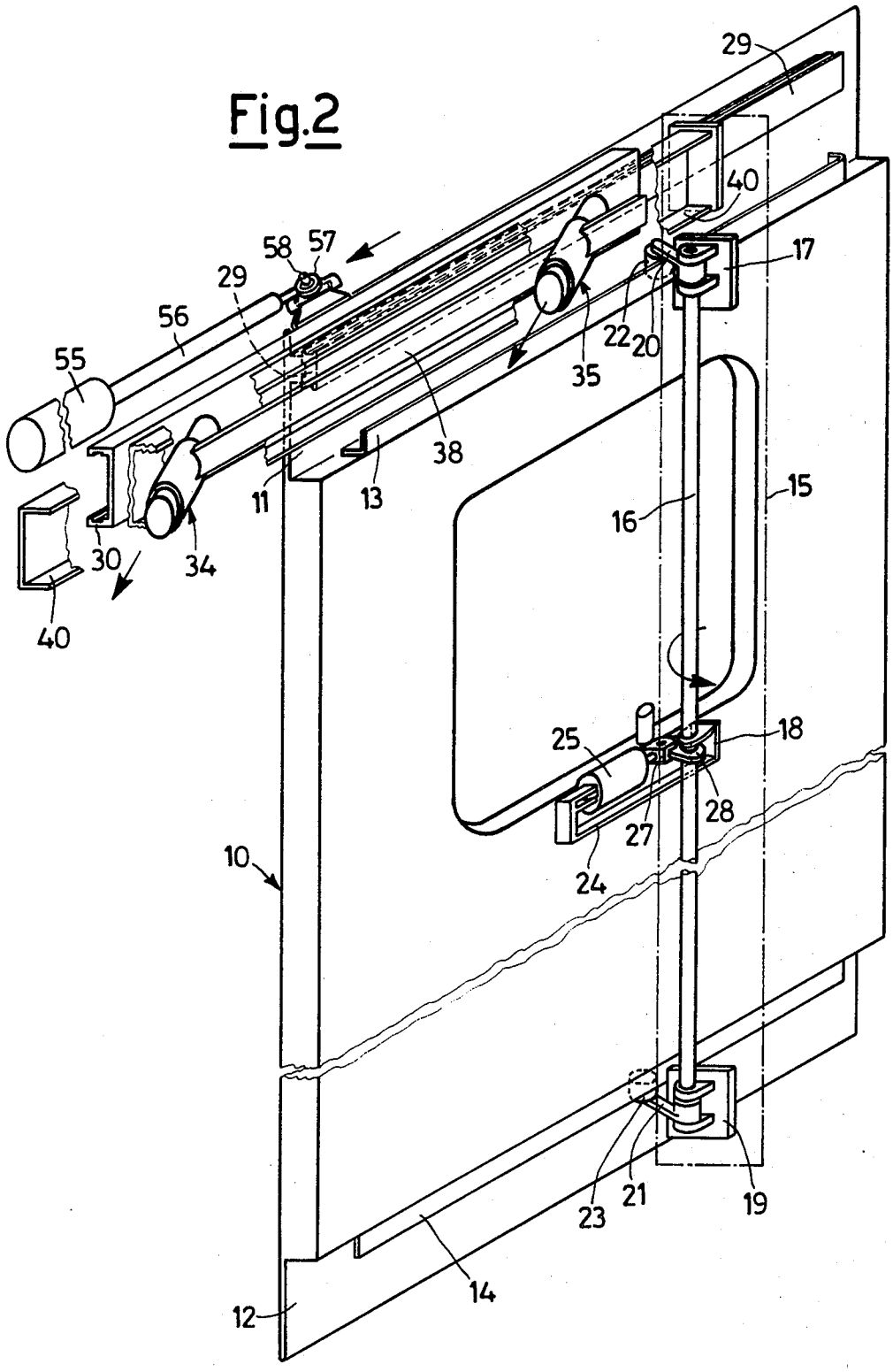

Having reference, at the outset, to FIGS. 1 and 2, the numeral 10 indicates the door panel, which can both be displaced and slid, of a vehicle (not shown in detail), the door panel in question having both on its top and bottom portions, undercuts such as 11 and 12, respectively, in its inside face. In these undercuts there are affixed top guides 13 and bottom guides 14, as formed by L-shaped rolled sections the ends of which being close to the vertical edge of the dor panel adjacent to the door post of the door space (indicated in dash and dot lines at 15) are curled towards the bottom of the relative undercut, as can be better seen in FIG. 7.

A vertical shaft 16 arranged parallely to the door post 15 and affixed to same by means of supporting members 17, 18, 19, carries, as keyed to its ends, two small connecting rods 20, 21, which in their turn, carry, at their free ends, followers such as 22, 23, lines with a non-metallic material and engaging the respective guides 13 and 14.

Figure 7:
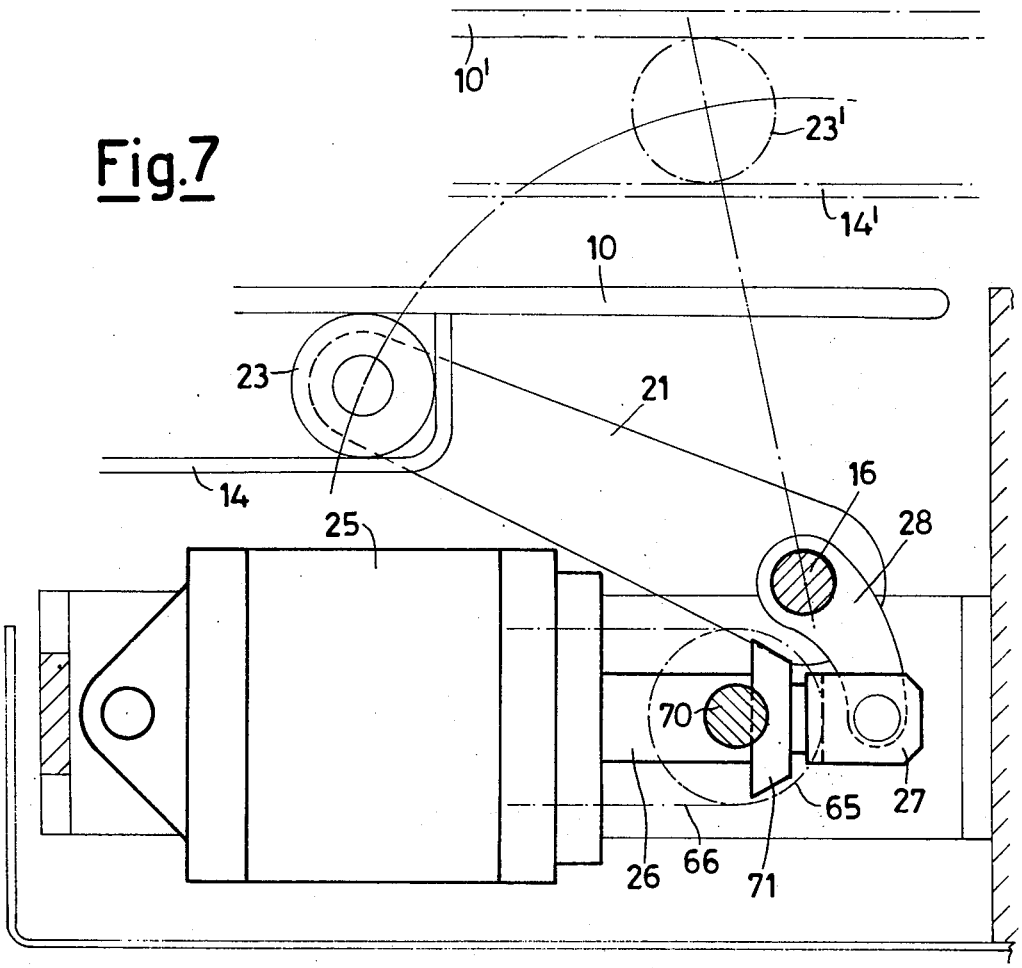
FIG. 7 is a plan view, partly in section, of the means for controlling the door panel displacement and the locking mechanism.

A bracket 24 integral with the intermediate supporting member 18 for the shaft 16, carries a pneumatic ram 25, the stem 26 of which in terminated by a fork 27, to which a link 28 is connected, which latter is keyed to the other end of the shaft 16 (best seen in FIG. 7.).

It is obvious that, with the stroke of the stem 26 in either direction, it is possible to impress a corresponding rotation to the shaft as well as to the connecting rods 20, 21 integral therewith, by a preselected angle. Such a rotation, as will be explained in more detail hereinafter, causes a corresponding displacement of the door panel 10 with respect to the door space so as to have the door panel either emerging out of its seat or coming back thereinto again.

Figure 5:
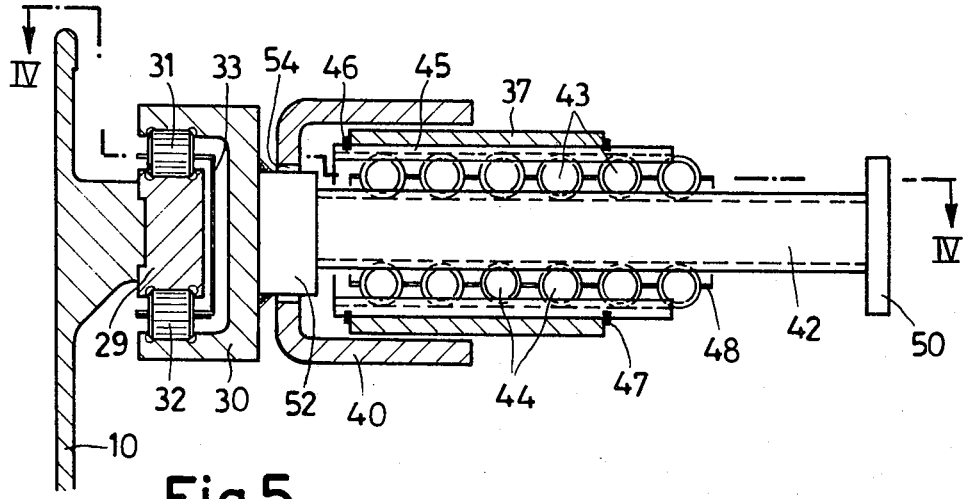
FIG. 5 is a vertical cross-sectional view taken along the polygonal line V—V of FIG. 4.

In the upper undercut 11 of the door panel 10, and parallely to its top edge there is fastened a sliding member 29 of a telescopable guide, the fixed member 30 of which has the shape of a U profile (see especially FIG. 5). In order to facilitate sliding, between these two members 29 and 30 of the telescopable guide there are inserted two rows of rollers 31 and 32, respectively, which are kept properly spaced apart in the longitudinal direction by a cage 33.

The member 30 of the telescopable guide is borne by the movable component parts of two linear ejectors, generally shown at 34 and 35, FIGS. 1 and 2, as will be better explained with reference to FIGS. from 4 to 6.

The fixed parts of these ejectors are formed by cylindrical bushings 36 and 37 rigidly connected to one another by a cross-beam 38. The cross-beam is secured by bolts 39 to a supporting structure formed by a U-profile, shown at 40, affixed at its ends to the sidewalls of the door space of the vehicle in correspondence with the ceiling of said door space (in FIGS. 1, 2 and 4 the mode of affixing the door post 15 is clearly shown).

The structural assembly comprises cross-beam profile 40, the bushings 36 and 37 and the ross-beam 38 and thus is a rigid supporting assembly as mounted in correspondence with the ceiling of the door space.

Figures 4, 6:
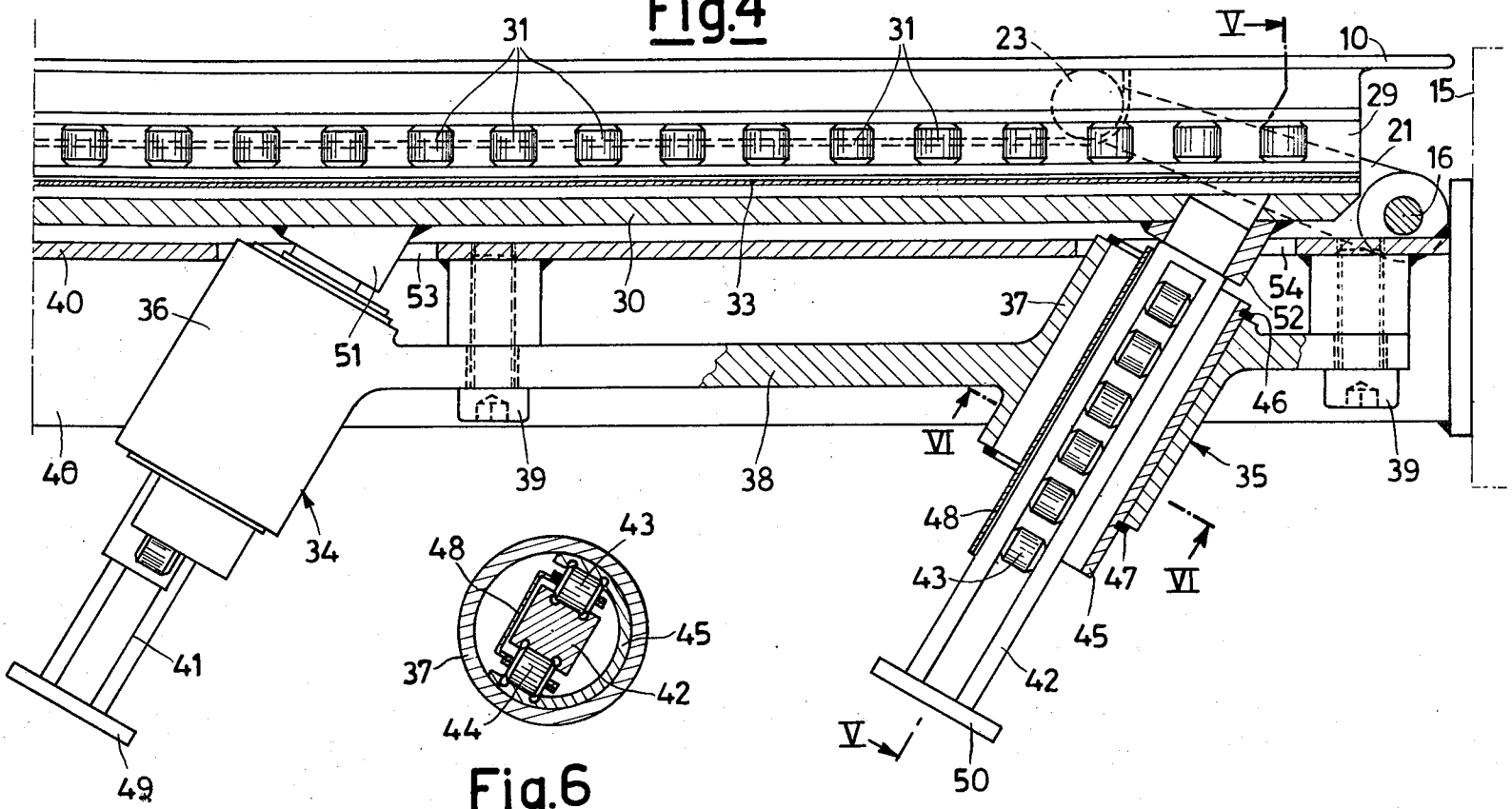
FIG. 4 is a horizontal cross-sectional view taken along the polygonal line IV—IV as shown in FIG. 6 and illustrates the suspension and sliding system according to the invention.
FIG. 6 shows one of the ejectors in cross-sectional view taken along the line VI—VI of FIG. 4.

The movable parts of the linear ejectors 34 and 35 are formed by stems 41 and 42 having a square cross-sectional shape (see FIG. 6) as mounted for sliding in the axial direction in the relative bushings 36 and 37 with the intermediary of two rows of rollers, such as 43 and 44 as viewed in FIG. 6. These rows of rollers have their rolling seat in a half-ring, such as 45, locked by means of Seeger rings such as 46 and 47, relative to the attendant bushing 37. An appropriate cage 48 keeps the rollers 43 and 44 appropriately spaced apart.

At either end, the stem 41 and 42 have enlarged headers 49 and 50, respectively, whereas the other end is rigidly locked in specially provided seats 51, 52 which protrude from the rear of the member 30 of the telescopable guide, to which said seats are affixed. Specially provided slots 53, 54 as formed through the profile 40, provide a passageway for the stems 41 and 42 and for the respective seats 51, 52 as clearly shown in FIG. 4.

The axes of the two bushings 36, 37 and the relative stems 41 and 42 are parallel to each other and form, in the example shown in the drawings, an angle "alpha" of about 60° with the plane which contains the door space: in addition, both these axes lie on a horizontal plane.

As outlined in the introductory part of this specification, this angle, however, may be varied from about 45° until becoming even a right angle: if so, the door is displaced perpendicularly with respect to its own seat.

Figure 3:
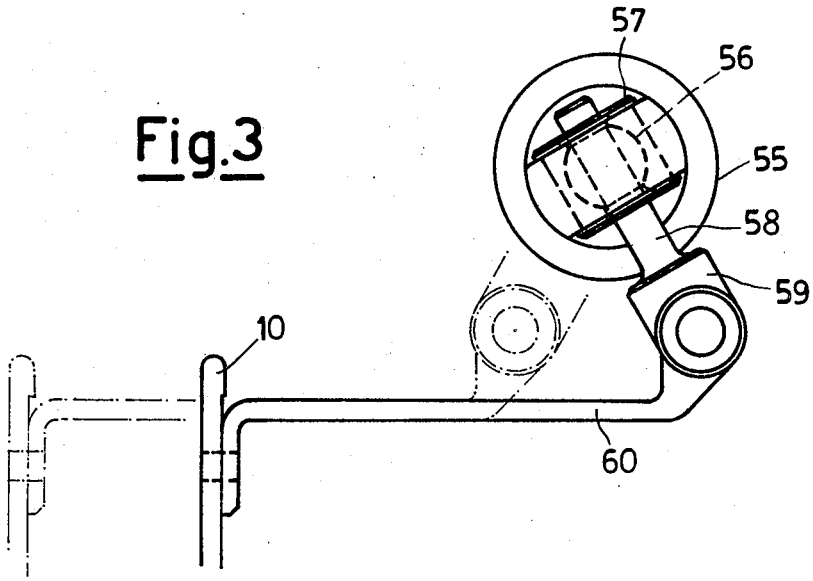
FIG. 3 is a detail section of the control mechanism for the door panel sliding movement.

For controlling the lateral sliding of the door panel (and thus also of the movable member 29 of the telescopable guide with respect to the fixed member 30) there is provided a pneumatic ram, as shown at 55 in FIGS. 1 to 3 inclusive, which is affixed to the vehicle body. The stem 56 of this ram is terminated by an eyelet 57 which engages a pin 58, the latter being terminated, in its turn by a fork 59 (FIG. 3) to which is linked an arm 60. The free end of the arm 60 is affixed to the door panel 10. In FIG. 3 the door panel 10 and the arm 60 are indicated in solid lines in the position where the door panel is closed and with dash and dot lines in the position where the door panel has emerged from the door space.

Figure 8:
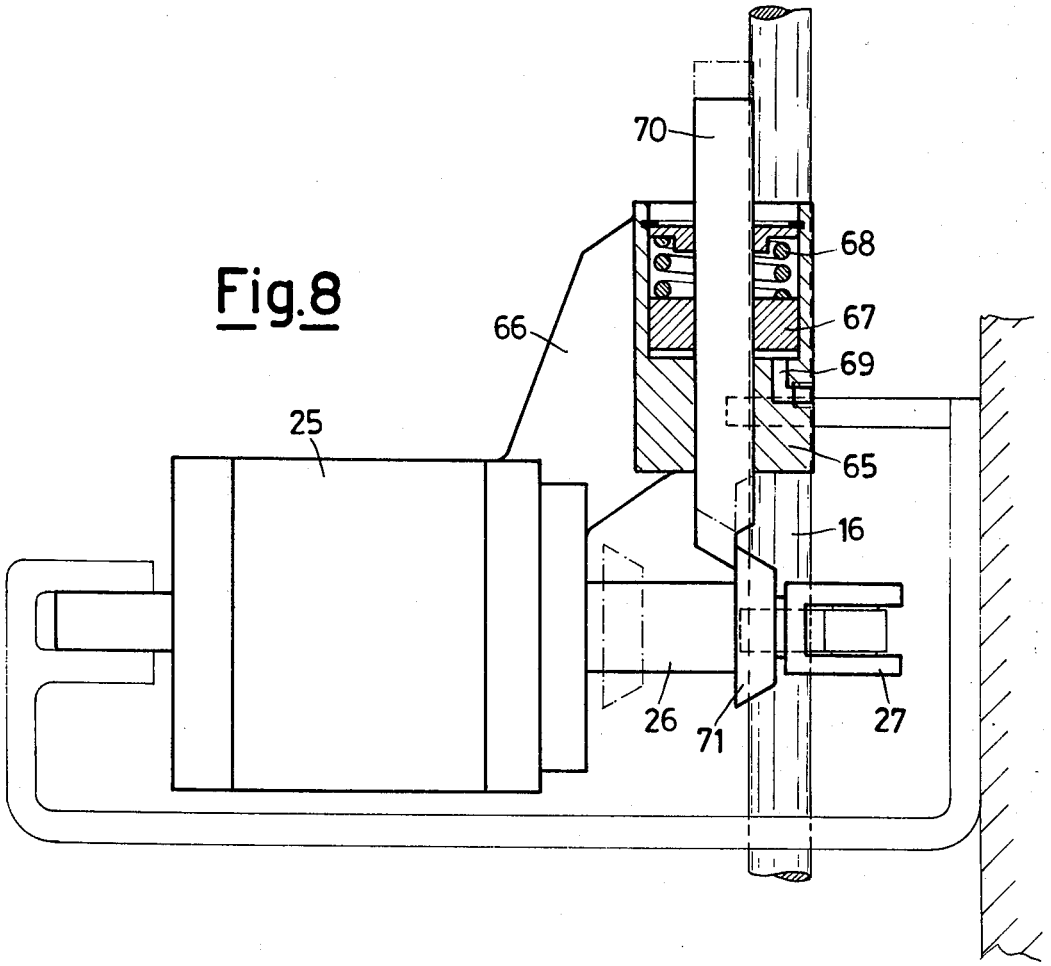
FIG. 8 is a side view of the means and mechanism as shown in FIG. 7.

The control of the rotation of the shaft 16 as formed by the pneumatic ram 25 is equipped with a locking device as shown in FIGS. 7 and 8.

Such a device is formed by a pneumatic ram 65 of the single-acting type, as mounted through a supporting member 66 on the ram 25. In the ram 65 a piston 67 can be reciprocated in a direction under the bias of a coil spring 68 and in the opposite direction under the thrust of compressed air as fed through a fitting 69. The piston 67 has integral therewith a latch 70 which, with one of its ends emerging from the ram 65 is adapted to cooperate with a stop disc 71 as keyed to the stem 26 of the ram 25 so as to lock same in its position where it juts out of the ram itself. The opposite end of the latch 70 also emerges from the ram 65 and can be connected to a manual emergency control (not shown).

From the foregoing, the operation of the door according to the invention is clearly apparent.

Starting from the closure position of the door panel (see FIGS. 1 and 7) wherein the shaft 16 is locked and prevented from rotating by the engagement of the latch 70 with the stop disc 71, so that also the door panel 10 is mechanically latched by connecting rods 20 and 21, it is required, at the outset, to feed compressed air into the ram 65 through the fitting 69 so as to release the stem 26. Subsequently, the stem 26 is driven in the direction adapted to have it entering the ram 25 again, so that, through the link 28, the shaft 16 is caused to rotate in the direction of the arrow shown in FIG. 1 and through a preselected angle. During this rotation, the connecting rods 20, 21, through the respective rollers 22, 23 impress to the door panel 10 a thrust, in such a direction as to have the door panel emerging from the door space in the direction allowed by the linear ejectors 34, 35. On completion of this movement, the headers 49, 50 of the stems 41, 42 of the ejectors abut the outer edges of the relevant half-rings 45. In FIG. 7 there is indicated, in dash and dot lines the position taken by the roller 23, the door panel 10 and the guide 14 after such a displacement, the relative parts being shown at 23', 10' and 14'.

At this stage the control mechanism for the lateral movement of the door panel can enter action. The pneumatic ram 55 is fed with compressed air so as to have the stem 56 emerging from the ram, that which causes the displacement of the door panel by sliding the member 29 of the telescopable guide relative to the member 30.

In the position where the door panel is open, the connecting rods 20, 21 profitably contribute towards imparting to the door panel a considerable stability.

In the closing stage, the sequence of the manipulations is reversed that is to say, that, at the outset, there is the lateral displacement of the door panel, and then its coming back to its said door space again together with the locking in the closed position.

The principal technical advantage achieved by the present invention is the improved stability of te suspension system as due to the fact that the displacement from and into the door space takes place, rather than in the conventional systems with a linked arm assembly, by means of linear ejectors which are rigidly mounted in a structure which is fastened to the vehicle body, the movable component parts being slidably guided by rolling systems as composed by sets of rollers.

It is understood that the scope of the present invention also includes a number of modifications and changes provided that the basic concept of the invention remains unaltered.

Thus, as outlined above, the linear ejectors can take a different inclination and the control means for the movement from and towards the door space could directly act upon the movable component parts of the ejectors.

In addition, of course, there can be provided appropriate adjusting means for the correct installation of the door and for the regulation of the strokes of the displacements.

What is claimed is:

1. A sliding-wing door for vehicles mounted on the vehicle body, comprising at least one door panel arranged to close a door space of the vehicle body, a telescopic guide extending parallelly to the door space at an upper edge thereof, said telescopic guide having a first member attached to an upper portion of said door panel and a second member connected to the vehicle body through at least two transversally directed linear ejectors mounted in a rigid support structure affixed to the vehicle body above the door space, there being provided first independently operable powered driving means for controlling movement of said second member of the guide with respect to said supporting structure in the axial direction of said linear ejectors and second independently operable powered driving means for controlling movement of said first member of the guide with respect to said second member in the axial direction of the guide, said second driving means including a piston-cylinder assembly interposed between said first member of the guide and the vehicle body.

2. A door according to claim 1, characterized in that the axes of the linear ejectors are parallel, lie on a horizontal plane and form with the door space plane an angle ranging from 45° to 90°.

3. A door according to claim 1, characterized in that the linear ejectors comprise a fixed portion as formed by a cylindrical bushing in the interior of which there is, linearally slidable by the agency of rolling members, the movable component part as composed by a stem.

4. A door according to claim 3, characterized in that said stem has at its end away of the end integral with the telescopable guide, an enlarged header adapted to abut the fixed part of the ejector.

5. A door according to claim 1, characterized in that a control means for the displacement of the door panel in a direction parallel to the axes of said linear ejectors are formed by a vertical shaft arranged parallelly to the door post of the door space and carrying at its ends connecting rods equipped with followers which engage guides affixed to the top and bottom of the door panel, means being provided to cause limited rotations in either directions of said shaft, said last mentioned means being formed by a pneumatic ram the stem of which is connected to said shaft by the agency of a link.

6. A door according to claim 5, characterized in that springing means are provided to lock the stem of said pneumatic ram in the position corresponding to the closed position of the door panel.

* * * * *